US009388823B2

(12) United States Patent
Ohtsuka et al.

(10) Patent No.: US 9,388,823 B2
(45) **Date of Patent: *Jul. 12, 2016**

(54) CENTRIFUGAL FAN, MOLDING DIE, AND FLUID FEEDER

(75) Inventors: Masaki Ohtsuka, Osaka (JP); Yukishige Shiraichi, Osaka (JP)

(73) Assignee: SHARP KABUSHIKI KAISHA, Osaka-shi (JP)

( * ) Notice: Subject to any disclaimer, the term of this patent is extended or adjusted under 35 U.S.C. 154(b) by 885 days.

This patent is subject to a terminal disclaimer.

(21) Appl. No.: 13/395,017

(22) PCT Filed: Sep. 7, 2010

(86) PCT No.: PCT/JP2010/065303

§ 371 (c)(1), (2), (4) Date: Mar. 8, 2012

(87) PCT Pub. No.: WO2011/030750

PCT Pub. Date: Mar. 17, 2011

(65) Prior Publication Data

US 2012/0171026 A1 Jul. 5, 2012

(30) Foreign Application Priority Data

Sep. 9, 2009 (JP) ..... 2009-208357

(51) Int. Cl.

*F04D 29/66* (2006.01)
*F04D 29/28* (2006.01)
*F04D 29/30* (2006.01)

(52) U.S. Cl.

CPC ..... *F04D 29/281* (2013.01); *F04D 29/30* (2013.01)

(58) Field of Classification Search

CPC ..... F05B 2240/40
USPC ..... 415/60, 77, 87, 206, 53.1, 53.2, 59.1; 416/90 R, 93 R, 162, 187, 193 R, 223 R, 416/228, 242, 243, 223 B, 178, 203
See application file for complete search history.

(56) References Cited

U.S. PATENT DOCUMENTS 6,769,876 B2 * 8/2004 Sakai et al. ..... 416/187
8,128,359 B2 * 3/2012 Chen ..... 415/220

(Continued)

FOREIGN PATENT DOCUMENTS

CN 1840313 A 10/2006
JP 58-64895 A 5/1983

(Continued)

OTHER PUBLICATIONS

English translation of Chinese Office Action, dated Mar. 27, 2014, for Chinese Application No. 201080040054.0.

(Continued)

*Primary Examiner* — Ninh H Nguyen
*Assistant Examiner* — Justin Seabe
(74) *Attorney, Agent, or Firm* — Birch, Stewart, Kolasch & Birch, LLP

(57) ABSTRACT

A centrifugal fan includes a plurality of fan blades circumferentially spaced apart from each other. The fan blade has a front edge portion to which air flows in a rear edge portion from which air flows out, and a blade surface extending between the front and rear edge portions. The blade surface includes a pressure surface on the rotation direction side of the centrifugal fan and a suction surface arranged on the back side of the pressure surface. The fan blade has a cross-sectional shape with concave portions formed at the pressure surface and the suction surface. Such a fan has an excellent blowing capacity. A molding die for use in production of the centrifugal fan, and a fluid feeder provided with the centrifugal fan are disclosed.

9 Claims, 9 Drawing Sheets

(56) References Cited

U.S. PATENT DOCUMENTS

| | | | | |
|---|---|---|---|---|
| 2006/0177304 | A1* | 8/2006 | Omori | F04D 29/30 415/206 |
| 2009/0028719 | A1 | 1/2009 | Teraoka et al. | |
| 2010/0186357 | A1 | 7/2010 | Takeda et al. | |

FOREIGN PATENT DOCUMENTS

| | | | |
|---|---|---|---|
| JP | 59-62293 | U | 4/1984 |
| JP | 63-31295 | U | 2/1988 |
| JP | 3-143620 | A | 6/1991 |
| JP | 5-106591 | A | 4/1993 |
| JP | 7-4388 | A | 1/1995 |
| JP | 8-247093 | A | 9/1996 |
| JP | 9-280196 | A | 10/1997 |
| JP | 2005-16315 | A | 1/2005 |
| JP | 2007-10259 | A | 1/2007 |
| JP | 2007-21352 | A | 2/2007 |
| JP | 2009-28681 | A | 2/2009 |

OTHER PUBLICATIONS

International Search Report (Form PCT/ISA/210), dated Dec. 21, 2010, for International Application No. PCT/JP2010/065303.

International Search Report (Form PCT/ISA/210), dated Dec. 21, 2010, for International Application No. PCT/JP2010/065304, with an English translation.

U.S. Office Action, dated Dec. 19, 2014, for U.S. Appl. No. 13/394,773.

* cited by examiner

CENTRIFUGAL FAN, MOLDING DIE, AND FLUID FEEDER

TECHNICAL FIELD

The present invention relates to a centrifugal fan, a molding die, and a fluid feeder, and particularly to a centrifugal fan for use in an air conditioner, an air purifier, and the like, a molding die for use in production of the centrifugal fan, and a fluid feeder provided with the centrifugal fan.

BACKGROUND ART

As for conventional centrifugal fans, for example, Japanese Patent Laying-Open No. 5-106591 discloses a sirocco fan for an air blower which aims to improve blowing efficiency (PTL 1). The sirocco fan for an air blower disclosed in PTL 1 is formed such that a plurality of vanes are disposed at regular intervals radially in a ring shape. Each vane is provided with a sub-blade for blowing air introduced from a hollow portion of the sirocco fan.

Japanese Patent Laying-Open No. 2009-28681 discloses an air purifier which aims to increase the circulation efficiency of air flow thereby to significantly increase the effect of improving indoor air environment without increasing air flow rate (PTL 2). The air purifier disclosed in PTL 2 is configured to include an intake for taking in air in a room, an air filter removing dust in the air taken in from the intake, an outlet blowing the air treated by the air filter to the room, and a blower moving the air from the intake to the outlet. A sirocco fan is used for the blower.

CITATION LIST

Patent Literature

PTL 1: Japanese Patent Laying-Open No. 5-106591
PTL 2: Japanese Patent Laying-Open No. 2009-28681

SUMMARY OF INVENTION

Technical Problem

In recent years, for conservation of global environment, further energy savings in home electric equipment are desired. For example, it is known that the efficiency of electric equipment such as an air conditioner and an air purifier greatly depends on the efficiency of a blower included therein. It is also known that reducing the weight of a fan blade provided as a rotating body in a blower reduces power consumption of a motor for rotatably driving the fan blade and improves the efficiency of the blower or a fluid feeder.

However, an aerofoil employed as the shape in cross section of a fan blade is essentially assumed to be applied to the wing of an air plane and is mainly found in the field of aeronautical engineering. Therefore, an aerofoil fan blade is mainly optimized in a high Reynolds number region and is not always appropriate as the cross section of a fan blade used in a low Reynolds number region for an air conditioner, an air purifier, etc. for home use.

When an aerofoil or double arc is employed as the cross-sectional shape of a fan blade, a thick portion exists in a range of 30 to 50% from the front edge of the fan blade. This increases the weight of the fan blade, which becomes a cause of increased friction loss during rotation. However, simply reducing the weight of a fan blade may reduce the strength of the fan blade and result in fracture or other poor quality.

For the reasons above, in order to save energy in electric equipment such as an air conditioner and an air purifier for home use, an appropriate blade cross-sectional shape has been sought for a fan blade to be used in the low Reynolds number region. A blade cross-sectional shape with a high lift-drag ratio, a small thickness and weight, and a high strength has also been sought.

Fans for use in an air blower include a centrifugal fan blowing air from the rotation center side of the fan to the radial direction. Examples of typical application of the centrifugal fan include an air conditioner. Reducing power consumption of an air conditioner is a high priority when more energy savings in home electric equipment are desired. There is a demand to increase air flow rate for the purpose of reducing power consumption of the air conditioner. The increase of air flow rate can increase the performance of evaporation and condensation of a heat exchanger and can reduce power consumption of a compressor, accordingly. However, the increase of air flow rate increases power consumption of the fan. Therefore, the balance between the reduction of power consumption in the compressor and the increase of power consumption in the fan amounts to a reduction of power consumption. Thus, the effect achieved by increasing the air flow rate of the fan cannot be maximized. On the other hand, if the rotation speed is increased with the same fan, as a means for increasing the air flow rate of the fan, the noise of the air conditioner is increased.

Another example of application of the centrifugal fan is an air purifier. An air purifier is requested to increase its dust-collecting capacity, that is, to increase the air flow rate, and to reduce noise. However, there is a tradeoff between these two requests. In response to such a problem, in the air purifier disclosed in PTL 2 above, the flow direction of the air from the outlet is set at an appropriate angle, so that the noise from the intake and the outlet of the air purifier is significantly reduced while the dust-collecting capacity is significantly improved by increasing the air flow rate.

However, a further increase of dust-collecting capacity, that is, an increase of air flow rate and a further noise reduction are desired. In order to satisfy these desires, it is necessary not only to reduce noise from the intake and the outlet of the air purifier but also to fundamentally reduce noise of the centrifugal fan that blows air. In order to increase the air flow rate, it is necessary to increase the rotation speed of the centrifugal fan. When the rotation speed of the centrifugal fan is increased, it is necessary to reduce input to the fan. It is also necessary to increase the strength of the fan blade to such an extent as to overcome the increased centrifugal force caused by the increased rotation speed of the centrifugal fan.

An object of the present invention is therefore to solve the aforementioned problems and to provide a centrifugal fan having an excellent blowing capacity, a molding die for use in production of the centrifugal fan, and a fluid feeder provided with the centrifugal fan.

Solution to Problem

A centrifugal fan according to the present invention includes a plurality of vane portions provided to be circumferentially spaced apart from each other. The vane portion has a front edge portion to which air flows in and a rear edge portion from which air flows out. The vane portion has a blade surface extending between the front edge portion and the rear edge portion. The blade surface includes a pressure surface arranged on a rotation direction side of the centrifugal fan and a suction surface arranged on a back side of the pressure surface. The vane portion has such a blade cross-sectional shape that a concave portion is formed at the pressure surface and the suction surface when the vane portion is cut along a plane orthogonal to a rotation axis of the centrifugal fan.

In the centrifugal fan configured in this manner, during rotation of the centrifugal fan, an air flow is produced to flow in from the front edge portion, pass through the blade surface, and flow out from the rear edge portion. Here, a vortex (secondary flow) of air flow is generated in the concave portion, so that the air flow (main flow) passing through the blade surface flows along the outside of the vortex generated in the concave portion. Accordingly, the vane portion exhibits a behavior like a thick blade as if the blade cross-sectional shape is increased in thickness by the amount of formation of the vortex. As a result, the blowing capacity of the centrifugal fan can be improved.

Preferably, the vane portion has a flection portion formed by flexing a center line of the blade cross-sectional shape extending between the front edge portion and the rear edge portion, at a plurality of points. The concave portion is formed by the flection portion. In the centrifugal fan configured in this manner, a vortex of air flow is generated in the concave portion formed by the flection portion, thereby improving the blowing capacity of the centrifugal fan.

Preferably, the flection portion is flexed such that a depth of the concave portion is larger than a thickness of the vane portion at least one point. In the centrifugal fan configured in this manner, a vortex of air flow can be generated in the concave portion more reliably.

Preferably, the concave portion is formed in the proximity of the front edge portion. In the centrifugal fan configured in this manner, the above-noted effect achieved by the concave portion is brought about in the proximity of the front edge portion, thereby generating a high lift. In addition, the formation of the flection portion can improve the strength of the vane portion in the proximity of the front edge portion.

Preferably, the concave portion is formed at a blade central portion between the front edge portion and the rear edge portion. In the centrifugal fan configured in this manner, the above-noted effect achieved by the concave portion is brought about in the blade central portion, so that the vane portion exhibits a stable ability as a blade. In addition, the formation of the flection portion can improve the strength of the vane portion in the blade central portion.

Preferably, the concave portion is formed to extend from one end to the other end of the blade surface in a rotation axis direction of the centrifugal fan. In the centrifugal fan configured in this manner, a vortex of air flow is generated in the concave portion formed to extend from one end to the other end of the blade surface in the rotation axis direction of the centrifugal fan, thereby improving the blowing capacity of the centrifugal fan more effectively.

Preferably, the concave portion is formed at the pressure surface and the suction surface to repeatedly appear in a direction in which the front edge portion is connected with the rear edge portion. In the centrifugal fan configured in this manner, a vortex of air flow is generated in the concave portion which repeatedly appears at the pressure surface and the suction surface, thereby improving the blowing capacity of the centrifugal fan more effectively.

Preferably, the concave portion formed at the pressure surface forms a convex portion at the suction surface, and the concave portion formed at the suction surface forms a convex portion at the pressure surface. In the centrifugal fan configured in this manner, a blade cross-sectional shape having a concave portion at the pressure surface and the suction surface can be easily obtained.

Preferably, in the blade cross-sectional shape, the concave portion is formed between convex portions appearing at the blade surface. The concave portion and the convex portions are formed to be alternately aligned in a direction in which the front edge portion is connected with the rear edge portion. In the centrifugal fan configured in this manner, a vortex of air flow is generated in the concave portion formed between the convex portions, thereby improving the blowing capacity more effectively.

Preferably, the vane portion has the blade cross-sectional shape having a generally constant thickness between the front edge portion and the rear edge portion. In the centrifugal fan configured in this manner, even when a vane portion having a blade cross-sectional shape having a generally constant thickness is used, the blowing capacity can be improved.

Preferably, the centrifugal fan is formed from resin. In the centrifugal fan configured in this manner, a light and high-strength centrifugal fan made of resin can be obtained.

A molding die according to the present invention is used to mold the centrifugal fan described above. With the molding die configured in this manner, a light and high-strength centrifugal fan made of resin can be manufactured.

A fluid feeder according to the present invention includes a blower configured to include any of the centrifugal fan described above and a driving motor coupled to the centrifugal fan to rotate a plurality of vane portions. In the fluid feeder configured in this manner, power consumption of the driving motor can be reduced while the blowing capacity is kept high.

Advantageous Effects of Invention

As described above, the present invention provides a centrifugal fan having an excellent blowing capacity, a molding die for the centrifugal fan, and a fluid feeder provided with the centrifugal fan.

DESCRIPTION OF EMBODIMENTS

Figure 1:
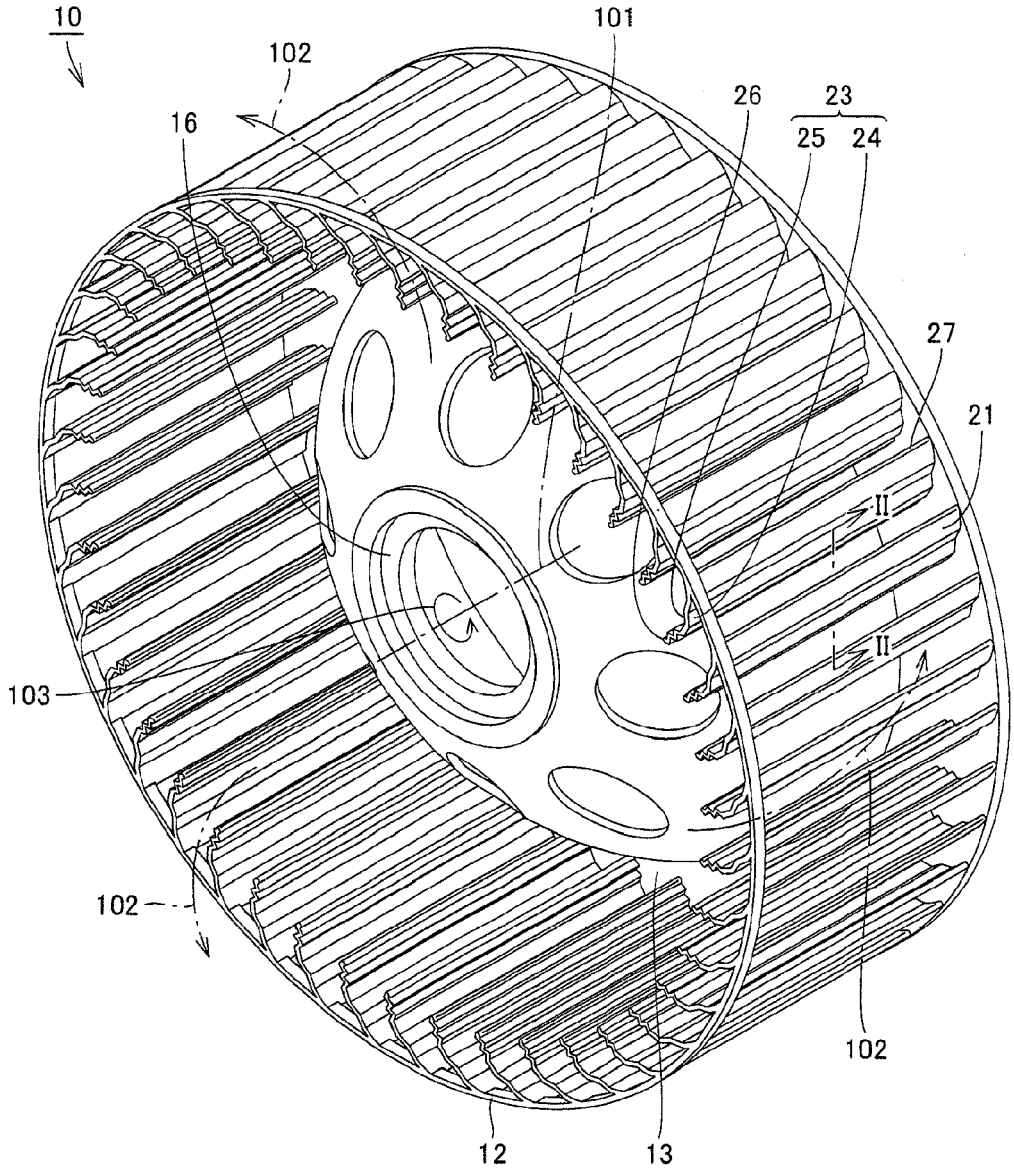
FIG. 1 is a perspective view of a centrifugal fan in a first embodiment of the present invention.

Embodiments of the present invention will be described with reference to the figures. In the following, the same or corresponding members in the figures are denoted with the same reference numerals.

First Embodiment

Figure 2:
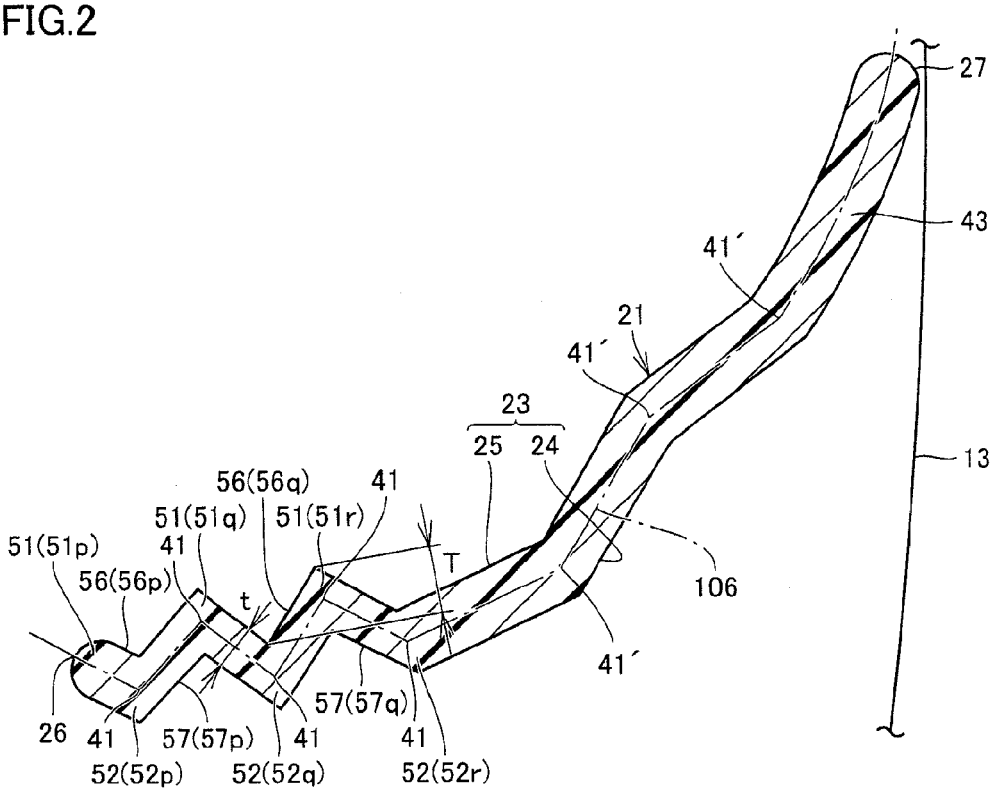
FIG. 2 is a cross-sectional view of the centrifugal fan taken along a line II-II in FIG. 1.

FIG. 1 is a perspective view of a centrifugal fan in a first embodiment of the present invention. FIG. 2 is a cross-sectional view of the centrifugal fan taken along a line II-II in FIG. 1.

Referring to FIG. 1 and FIG. 2, a centrifugal fan 10 in the present embodiment has a plurality of fan blades 21. Centrifugal fan 10 has an approximately cylindrical appearance as a whole. A plurality of fan blades 21 are arranged on a side surface of the approximately cylindrical shape. Centrifugal fan 10 is integrally formed from resin. Centrifugal fan 10 rotates in the direction shown by an arrow 103 around an imaginary center axis 101 shown in FIG. 1.

Centrifugal fan 10 is a fan using a plurality of rotating fan blades 21 to blow air taken in from the radially inner side to the radially outer side. Centrifugal fan 10 is a fan using a centrifugal force to blow the air from the rotation center side of the fan to the radial direction thereof. Centrifugal fan 10 is a sirocco fan. Centrifugal fan 10 is used with rotation speeds in a low Reynolds number region applied to a fan of home electrical equipment, etc.

Centrifugal fan 10 further has a peripheral frame 12 and a peripheral frame 13 serving as supports. Peripheral frames 12, 13 are formed to annually extend around center axis 101. Peripheral frame 12 and peripheral frame 13 are arranged to be spaced apart from each other in the axial direction of center axis 101. In the present embodiment, a boss portion 16 for coupling centrifugal fan 10 to a driving motor is integrally formed with peripheral frame 13.

A plurality of fan blades 21 are arranged to be spaced apart from each other in the circumferential direction around center axis 101. A plurality of fan blades 21 are arranged at regular intervals in the circumferential direction around center axis 101. A plurality of fan blades 21 are supported by peripheral frame 12 and peripheral frame 13 at opposite ends in the axial direction of center axis 101. Fan blade 21 is provided to stand on peripheral frame 13 and formed to extend along the axial direction of center axis 101 toward peripheral frame 12.

A plurality of fan blades 21 have a shape equal to each other. Fan blade 21 has a front edge portion 26 and a rear edge portion 27. Front edge portion 26 is arranged at an end portion at the radially inner side of fan blade 21. Rear edge portion 27 is arranged at an end portion at the radially outside of fan blade 21. Fan blade 21 is formed to be inclined in the circumferential direction around center axis 101 from front edge portion 26 toward rear edge portion 27. Fan blade 21 is formed to be inclined in the rotation direction of centrifugal fan 10 from front edge portion 26 toward rear edge portion 27.

Fan blade 21 has a blade surface 23 including a pressure surface 25 and a suction surface 24. Pressure surface 25 is arranged on the rotational direction side of centrifugal fan 10. Suction surface 24 is arranged on the back side of pressure surface 25. During rotation of centrifugal fan 10, as an air flow is produced on blade surface 23, a pressure distribution is generated such that pressure is relatively large at pressure surface 25 and is relatively small at suction surface 24. Fan blade 21 has a shape generally curved between front edge portion 26 and rear edge portion 27 so as to be concave on the pressure surface 25 side and be convex on the suction surface 24 side.

FIG. 2 shows a blade cross-sectional view of fan blade 21 cut along the plane orthogonal to center axis 101 serving as the rotation axis of centrifugal fan 10.

Fan blade 21 is formed to have the same blade cross-sectional shape when it is cut at any place in the axial direction of center axis 101. Fan blade 21 is formed to have a thin blade cross-sectional shape. Fan blade 21 is formed to have a generally constant thickness (the length between pressure surface 25 and suction surface 24) between front edge portion 26 and rear edge portion 27.

Fan blade 21 has such a blade cross-sectional shape that concave portions 56 are formed at pressure surface 25 of blade surface 23 and concave portions 57 are formed at suction surface 24 of blade surface 23.

More specifically, a plurality of concave portions 56 (concave portions 56*p*, 56*q*) are formed at pressure surface 25. A plurality of convex portions 51 (convex portions 51*p*, 51*q*, 51*r*) are further formed at pressure surface 25. Convex portion 51 is formed to protrude toward the rotation direction of centrifugal fan 10. Concave portion 56 is formed by a valley portion between convex portions 51 arranged adjacent to each other. For example, concave portion 56*p* is formed by a valley portion between convex portion 51*p* and convex portion 51*q*. Concave portions 56 and convex portions 51 are formed to be alternately aligned in the direction in which front edge portion 26 is connected with rear edge portion 27. Concave portion 56 has an approximately V-shaped cross-sectional shape.

A plurality of concave portions 57 (concave portions 57*p*, 57*q*) are formed at suction surface 24. A plurality of convex portions 52 (convex portions 52*p*, 52*q*, 52*r*) are further formed at suction surface 24. Convex portion 52 is formed to protrude toward the direction opposite to the rotation direction of centrifugal fan 10. Concave portion 57 is formed by a valley portion between convex portions 52 arranged adjacent to each other. For example, concave portion 57*p* is formed by a valley portion between convex portion 52*p* and convex portion 52*q*. Concave portions 57 and convex portions 52 are formed to be alternately aligned in the direction in which front edge portion 26 is connected with rear edge portion 27. Concave portion 57 has an approximately V-shaped cross-sectional shape.

Concave portion 56 and convex portion 52 are formed at front and back corresponding positions of pressure surface 25 and suction surface 24, respectively. Convex portion 51 and concave portion 57 are formed at front and back corresponding positions of pressure surface 25 and suction surface 24, respectively. In the present embodiment, concave portion 56 formed at pressure surface 25 forms convex portion 52 at suction surface 24, and concave portion 57 formed at suction surface 24 forms convex portion 51 at pressure surface 25. The concave portion and the convex portion formed at the front and the back correspondingly at pressure surface 25 and suction surface 24 have a cross-sectional shape equal to each other.

In the present embodiment, the number of the concave portions formed at pressure surface 25 and the number of the concave portions formed at suction surface 24 are the same.

The present invention is not limited thereto, and the number of the concave portions formed at pressure surface 25 may be greater than the number of the concave portions formed at suction surface 24, or the number of the concave portions formed at suction surface 24 may be greater than the number of the concave portions formed at pressure surface 25.

Concave portions 56, 57 are shaped like a groove extending along the axial direction of center axis 101. The groove portion formed of each concave portion 56, 57 is formed to continuously extend between one end and the other end of fan blade 21 in the axial direction of center axis 101. The groove portion formed of each concave portion 56, 57 is formed to linearly extend between one end and the other end of fan blade 21 in the axial direction of center axis 101.

FIG. 2 shows a center line 106 in the thickness direction (the direction in which pressure surface 25 is connected with suction surface 24) of the blade cross-sectional shape of fan blade 21. Fan blade 21 has flection portions 41 at which center line 106 of the blade cross-sectional shape of fan blade 21 is flexed at a plurality of points between front edge portion 26 and rear edge portion 27. Concave portions 56, 57 are formed by flection portions 41.

In the present embodiment, flection portions 41 are arranged in the proximity of front edge portion 26. As a result, concave portions 56, 57 are formed in the proximity of front edge portion 26. More specifically, convex portion 51*p* is formed at front edge portion 26, concave portion 56*p* and convex portion 52*p*, convex portion 51*q* and concave portion 57*p*, concave portion 56*q* and convex portion 52*q*, convex portion 51*r* and concave portion 57*q*, and convex portion 52*r* are formed to be successively aligned in this order from convex portion 51*p*. Concave portions 56, 57 are formed on the side closer to front edge portion 26 where the entire length of center line 106 is halved between front edge portion 26 and rear edge portion 27. Flection portions 41 are flexed such that the depth T of concave portions 56, 57 is greater than the thickness t of fan blade 21 at least one point. Flection portions 41 are formed such that the bending direction is alternately opposite in the direction in which front edge portion 26 is connected with rear edge portion 27.

Fan blade 21 has flection portions 41 whose bending angle is large at a region relatively close to front edge portion 26 and has flection portions 41' whose bending angle is small at a region relatively far from front edge portion 26. Fan blade 21 has a curved portion 43 extending to be curved from rear edge portion 27 toward front edge portion 26, at a region adjacent to rear edge portion 27.

Figure 3:
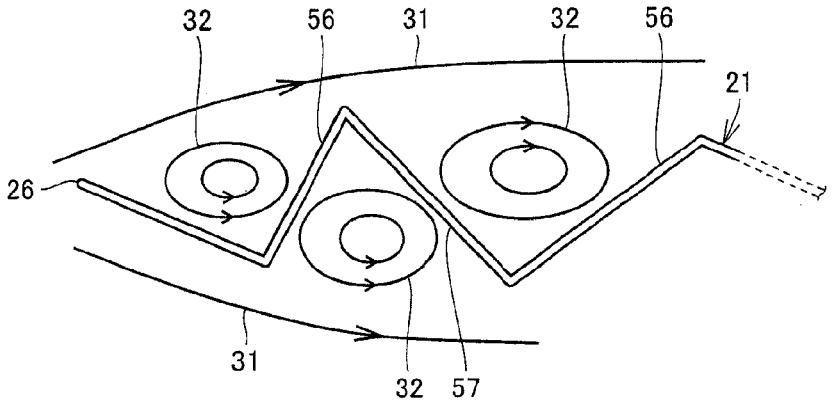
FIG. 3 is a diagram schematically showing a phenomenon that occurs on a blade surface of a fan blade in FIG. 2.

FIG. 3 is a diagram schematically showing a phenomenon that occurs on the blade surface of the fan blade in FIG. 2. Referring to FIG. 1 to FIG. 3, when centrifugal fan 10 is rotated, as shown by an arrow 102 in FIG. 1, an air flow is produced to flow in from front edge portion 26, pass through on blade surface 23, and flow out from rear edge portion 27. Here, a vortex 32 (secondary flow) of air flow is generated at concave portions 56, 57 formed at blade surface 23, so that an air flow 31 (main flow) passing through on fan blade 23 flows along the outside of vortex 32 produced at concave portions 56, 57.

Accordingly, although having a thin blade cross-sectional shape, fan blade 21 exhibits a behavior like a thick blade as if the blade cross-sectional shape is increased in thickness by the depth of concave portions 56, 57 at which vortexes 32 are formed. As a result, the lift produced in the proximity of front edge portion 26 having concave portions 56, 57 can be significantly increased. Furthermore, the flection structure of flection portions 41 can improve the strength of fan blade 21. As a result, the reliability in the strength of centrifugal fan 10 can be improved.

The structure of centrifugal fan 10 in the first embodiment of the present invention as described above is summarized as follows. Centrifugal fan 10 in the present embodiment includes fan blades 21 serving as a plurality of vane portions provided to be circumferentially spaced apart from each other. Fan blade 21 has front edge portion 26 to which air flows in and rear edge portion 27 from which air flows out. Fan blade 21 has blade surface 23 formed to extend between front edge portion 26 and rear edge portion 27. Blade surface 23 has pressure surface 25 arranged on the rotation direction side of centrifugal fan 10 and suction surface 24 arranged on the back side of pressure surface 25. When cut along the plane orthogonal to center axis 101 serving as the rotation axis of centrifugal fan 10, fan blade 21 has such a blade cross-sectional shape that concave portions 56 and concave portions 57 are formed at pressure surface 25 and suction surface 24, respectively.

In centrifugal fan 10 in the first embodiment of the present invention configured in this manner, the lift produced with rotation of fan blade 21 can be significantly increased in the low Reynolds number region applied to a fan for home electric equipment, etc. Accordingly, power consumption for driving centrifugal fan 10 can be reduced.

In centrifugal fan 10 in the present embodiment, while the strength of fan blade 21 is improved by flection portions 41, the thickness of fan blade 21 can be reduced correspondingly. Accordingly, weight reduction and cost reduction of centrifugal fan 10 can be achieved. Because of the reasons above, centrifugal fan 10 having a blade cross-sectional shape with a high lift-drag ratio, with a small thickness and weight, and with a high strength can be obtained.

Second Embodiment

Figure 4:
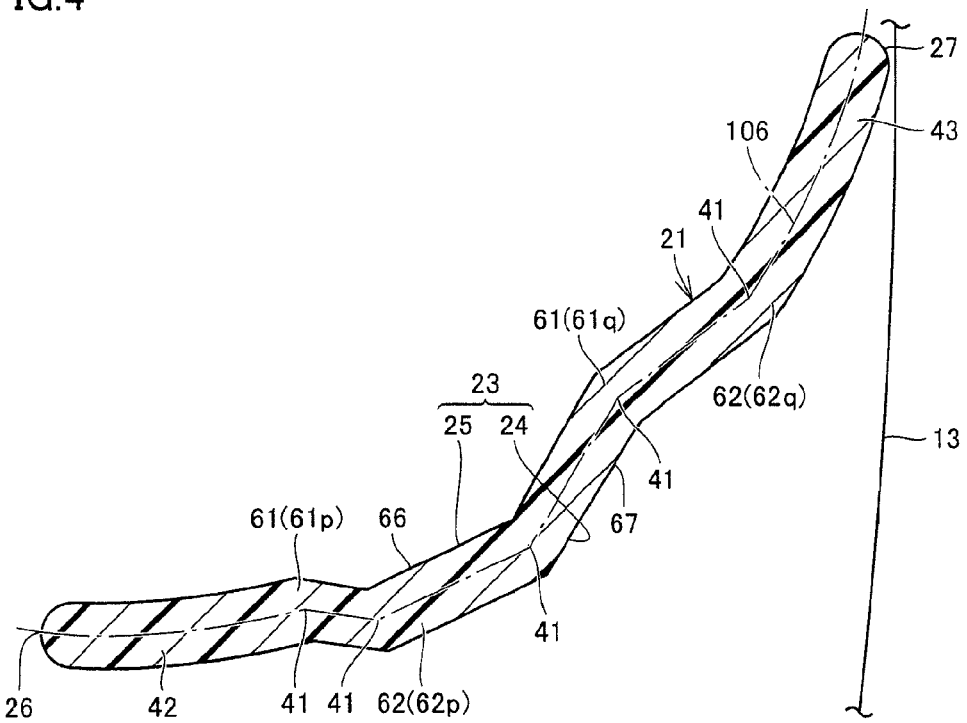
FIG. 4 is a cross-sectional view of a centrifugal fan in a second embodiment of the present invention.

FIG. 4 is a cross-sectional view of a centrifugal fan in a second embodiment of the present invention. FIG. 4 is a diagram corresponding to FIG. 2 in the first embodiment. In comparison with centrifugal fan 10 in the first embodiment, a centrifugal fan in the present embodiment basically has a similar structure. A description of the overlapping structure will not be repeated below.

Referring to FIG. 4, in the present embodiment, fan blade 21 has such a blade cross-section shape that a concave portion 66 is formed at pressure surface 25 of blade surface 23 and a concave portion 67 is formed at suction surface 24 of blade surface 23.

A plurality of convex portions 61 (convex portions 61*p*, 61*q*) are further formed at pressure surface 25. Convex portion 61 is formed to protrude toward the rotation direction of the centrifugal fan. Concave portion 66 is formed by a valley portion between convex portion 61*p* and convex portion 61*q*. Concave portion 66 and convex portions 61 are formed to be alternately aligned in the direction in which front edge portion 26 is connected with rear edge portion 27. Concave portion 66 has an approximately rectangular cross-sectional shape with one side open. Concave portion 66 is formed of a bottom surface and a pair of side surfaces that define the approximately rectangular cross-sectional shape, and is shaped such that the distance between the pair of side surfaces gradually increases as it is further away from the bottom surface.

A plurality of convex portions 62 (convex portions 62*p*, 62*q*) are further formed at suction surface 24. Convex portion 62 is formed to protrude toward the direction opposite to the rotation direction of the centrifugal fan. Concave portion 67 is formed by a valley portion between convex portion 62*p* and convex portion 62*q*. Concave portion 67 and convex portions 62 are formed to be alternately aligned in the direction in which front edge portion 26 is connected with rear edge portion 27. Concave portion 67 has an approximately V-shaped cross-sectional shape.

Concave portions 66, 67 are formed by flection portions 41 at which center line 106 of the blade cross-sectional shape of fan blade 21 is flexed at plurality of points between front edge portion 26 and rear edge portion 27.

In the present embodiment, flection portions 41 are arranged at a blade central portion between front edge portion 26 and rear edge portion 27, and as a result, concave portions 66, 67 are formed at the blade central portion. More specifically, concave portion 66 and concave portion 67 are formed at positions away from front edge portion 26 and rear edge portion 27, respectively, by a prescribed length, in the entire length direction of center line 106. Fan blade 21 has a curved portion 42 extending to be curved from front edge portion 26 toward rear edge portion 27, at a region adjacent to front edge portion 26, and has a curved portion 43 extending to be curved from rear edge portion 27 toward front edge portion 26, at a region adjacent to rear edge portion 27. Concave portion 66 and concave portion 67 are formed between curved portion 42 and curved portion 43.

Flection portions 41 include a place at which the bending direction is the same in succession in the direction in which front edge portion 26 is connected with rear edge portion 27. The flection portions 41 at this place form concave portion 66 having an approximately rectangular cross-sectional shape.

When concave portions 66, 67 are formed at the blade central portion of fan blade 21, the effect of suppressing separation of airflow produced in the blade central portion is further achieved. Accordingly, broadband noise generated in the centrifugal fan can be effectively suppressed.

The centrifugal fan in the second embodiment of the present invention configured in this manner can achieve the effect described in the first embodiment, similarly.

Third Embodiment

In the present embodiment, a variety of modification of centrifugal fan 10 in the first embodiment will be described.

Figure 5:
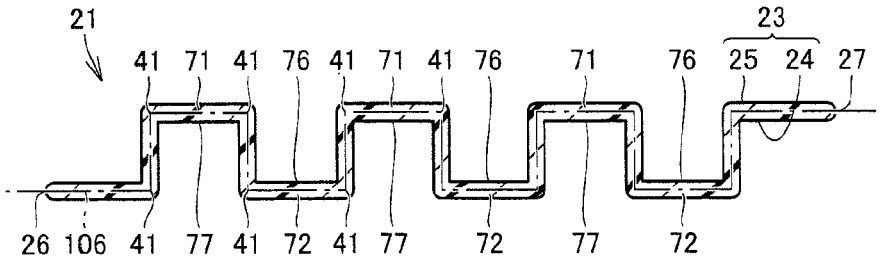
FIG. 5 is a cross-sectional view of a first modification of the centrifugal fan in FIG. 1.

FIG. 5 is a cross-sectional view of a first modification of the centrifugal fan in FIG. 1. Referring to FIG. 5, fan blade 21 has such a blade cross-sectional shape that concave portions 76 are formed at pressure surface 25 of blade surface 23 and concave portions 77 are formed at suction surface 24 of blade surface 23. A plurality of concave portions 76 are formed at pressure surface 25. A plurality of convex portions 71 are further formed at pressure surface 25. Concave portion 76 is formed by a valley portion between the adjacent convex portions 71. A plurality of concave portions 77 are formed at suction surface 24. A plurality of convex portions 72 are further formed at suction surface 24. Concave portion 77 is formed by a valley portion between the adjacent convex portions 72.

In this modification, concave portion 76 and concave portion 77 each have an approximately rectangular cross-sectional shape with one side open. Concave portion 76 formed at pressure surface 25 forms convex portion 72 at suction surface 24, and concave portion 77 formed at suction surface 24 forms convex portion 71 at pressure surface 25.

Fan blade 21 has a generally constant thickness between front edge portion 26 and rear edge portion 27. Concave portions 76, 77 are formed by flection portions 41 at which center line 106 of the blade cross-section shape of fan blade 21 is flexed at a plurality of points between front edge portion 26 and rear edge portion 27. Flection portions 41 are formed such that a cycle in which the bending direction is the same twice in succession and is opposite twice in succession is repeated more than once.

As shown in this modification by way of example, the cross section of the concave portion formed at blade surface 23 is not limited to a V shape but may be a rectangular shape or any other shape.

Figure 6:
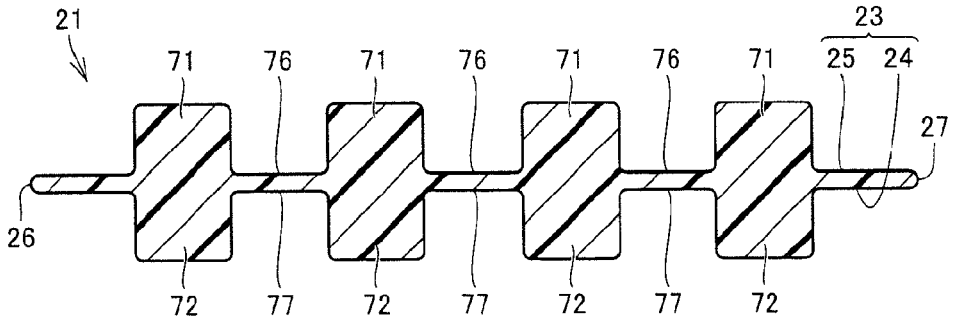
FIG. 6 is a cross-sectional view of a second modification of the centrifugal fan in FIG. 1.

FIG. 6 is a cross-sectional view of a second modification of the centrifugal fan in FIG. 1. Referring to FIG. 6, in this modification, concave portion 76 and concave portion 77 are formed at the front and back corresponding positions of pressure surface 25 and suction surface 24, respectively. Convex portion 71 and convex portion 72 are formed at the front and back corresponding positions of pressure surface 25 and suction surface 24, respectively. Fan blade 21 has a thickness that is relatively small at a position having concave portion 76 and concave portion 77 and is relatively large at a position having convex portion 71 and convex portion 72, between front edge portion 26 and rear edge portion 27.

As shown in the present modification, fan blade 21 may have different thicknesses between front edge portion 26 and rear edge portion 27. Concave portions 76, 77 and convex portions 71, 72 may be formed at positions shifted from each other between pressure surface 25 and suction surface 24.

Figure 7:
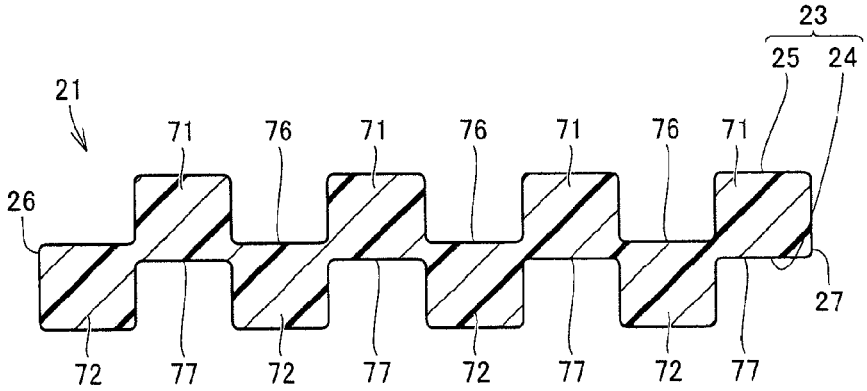
FIG. 7 is a cross-sectional view of a third modification of the centrifugal fan in FIG. 1.

FIG. 7 is a cross-sectional view of a third modification of the centrifugal fan in FIG. 1. Referring to FIG. 7, in the present modification, concave portion 76 and convex portion 72 are formed at the front and back corresponding positions of pressure surface 25 and suction surface 24, respectively, and convex portion 71 and concave portion 77 are formed at the front and back corresponding positions of pressure surface 25 and suction surface 24, respectively. Fan blade 21 has a thickness that is equal between the position having concave portion 76 and convex portion 72 and the position having convex portion 71 and concave portion 77.

As shown in the present modification, the present invention is not limited to such a structure that concave portion 76 formed at pressure surface 25 forms convex portion 72 at suction surface 24 and that concave portion 77 formed at suction surface 24 forms convex portion 71 at pressure surface 25.

Figure 8:
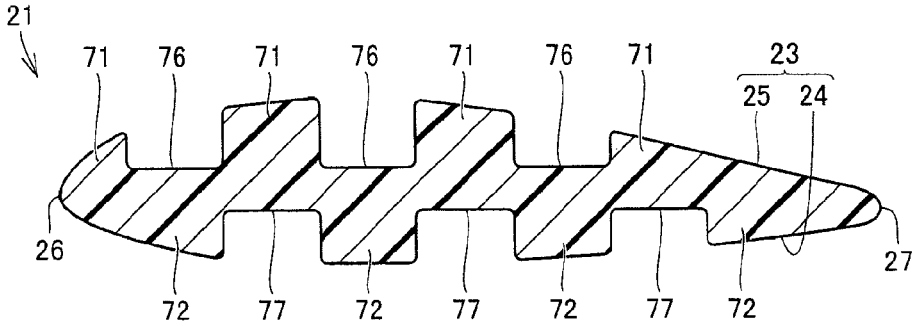
FIG. 8 is a cross-sectional view of a fourth modification of the centrifugal fan in FIG. 1.

FIG. 8 is a cross-sectional view of a fourth modification of the centrifugal fan in FIG. 1. Referring to FIG. 8, in the present modification, fan blade 21 has a blade cross-sectional shape of an aerofoil as a whole such that the thickness is the largest in the proximity of front edge portion 26 and the thickness gradually decreases from that position toward rear edge portion 27. Fan blade 21 has concave portions 76, 77 that are formed to be recessed from the surface of blade surface 23 extending in the aerofoil.

As shown in the present modification by way of example, fan blade 21 is not limited to a structure having such a cross-sectional shape that is thin as a whole but may have an aerofoil or any other cross-sectional shape. Fan blade 21 is not limited to a structure as shown in FIG. 5 in which concave portions 76 and concave portions 77 are formed by flection portions 41 and may have a structure as in the present embodiment in which concave portions 76 and concave portions 77 are formed by partially recessing blade surface 23 extending in a flat shape or curved shape.

Figure 9:
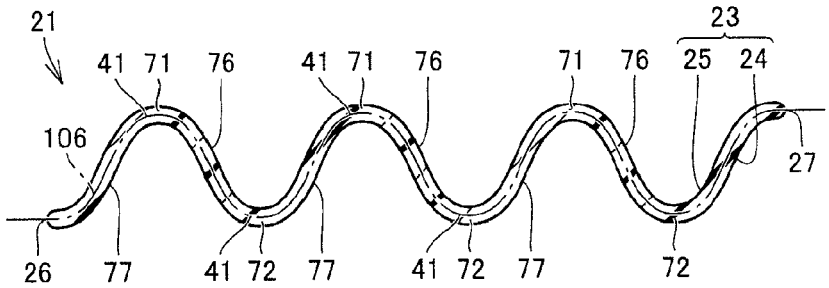
FIG. 9 is a cross-sectional view of a fifth modification of the centrifugal fan in FIG. 1.

FIG. 9 is a cross-sectional view of a fifth modification of the centrifugal fan in FIG. 1. Referring to FIG. 9, in the present modification, concave portions 76, 77 are formed by flection portion 41 at which center line 106 of the blade cross-sectional shape of fan blade 21 is flexed at a plurality of points between front edge portion 26 and rear edge portion 27. Flection portions 41 are formed to be bent in a rounded shape. Fan blade 21 has an S-shaped blade cross-sectional shape. Blade surface 23 (pressure surface 25 and suction surface 24) extends to be continuously curved between front edge portion 26 and rear edge portion 27.

As shown in the present modification, flection portions 41 that form concave portions 76, 77 may be formed not only to be bent to form a corner but also to be bent in a rounded shape.

The centrifugal fan in the third embodiment of the present invention configured in this manner can achieve the effect described in the first embodiment, similarly.

Fourth Embodiment

In this embodiment, a molding die for use in production of centrifugal fan 10 in FIG. 1 and a blower and an air purifier using centrifugal fan 10 in FIG. 1 will be described.

Figure 10:
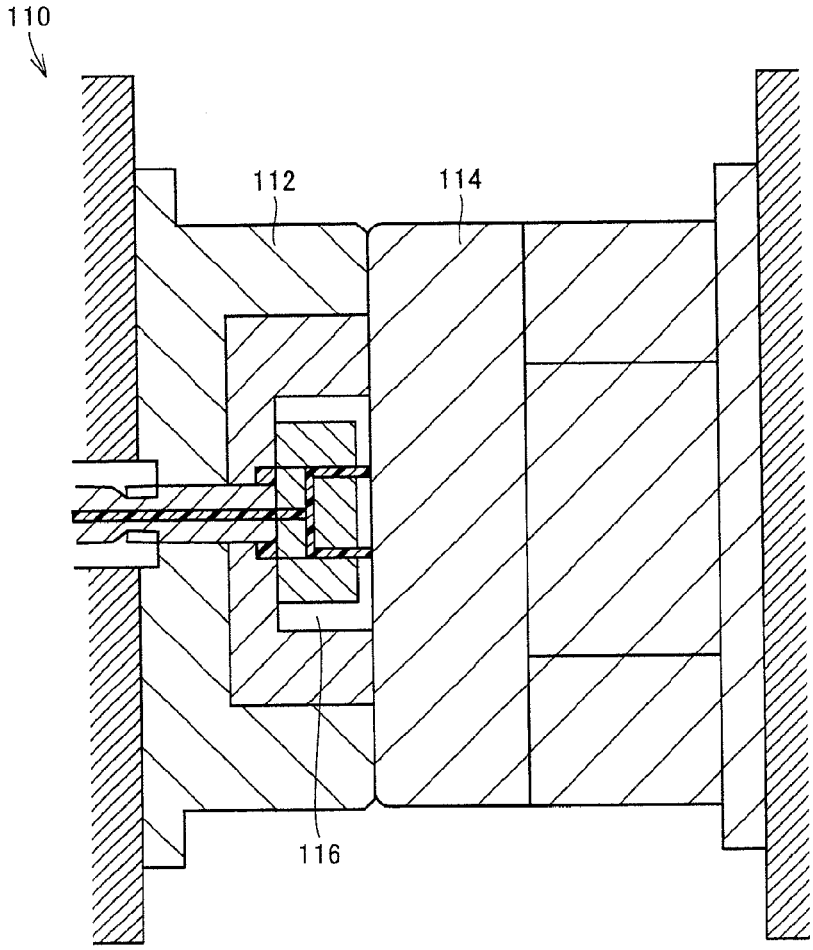
FIG. 10 is a cross-sectional view of a molding die for use in production of the centrifugal fan in FIG. 1.

FIG. 10 is a cross-sectional view of a molding die for use in production of the centrifugal fan in FIG. 1. Referring to FIG. 10, a molding die 110 has a stationary die 114 and a movable die 112. Stationary die 114 and movable die 112 define a cavity 116 which has approximately the same shape as centrifugal fan 10 and into which flowable resin is injected.

Molding die 110 may be provided with a not-shown heater for increasing the flowability of resin injected into cavity 116. The installation of such a heater is particularly effective, for example, when synthetic resin with an increased strength, such as glass-fiber-filled AS resin, is used.

Figure 11:
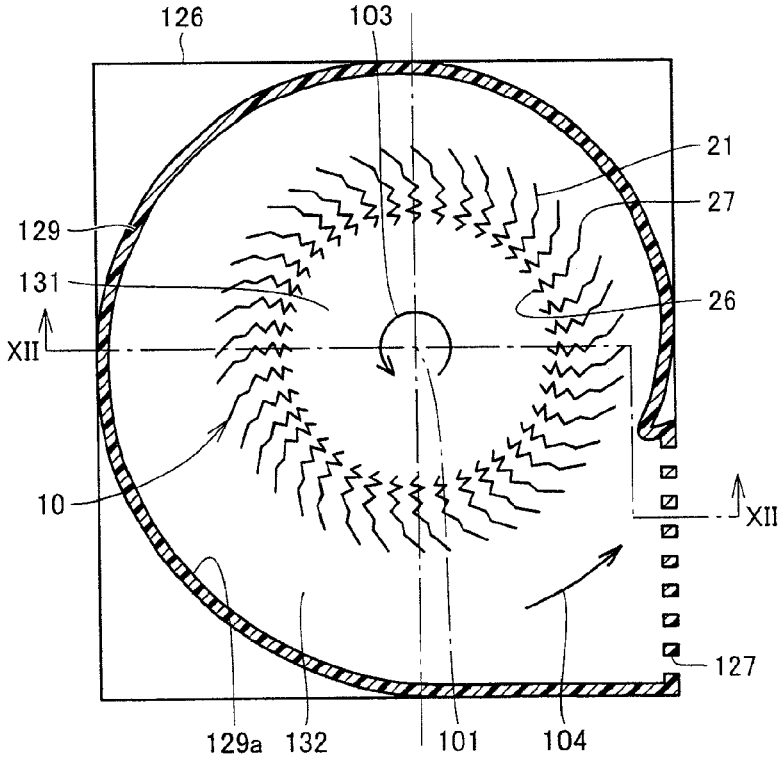
FIG. 11 is a cross-sectional view of a blower using the centrifugal fan in FIG. 1.
Figure 12:
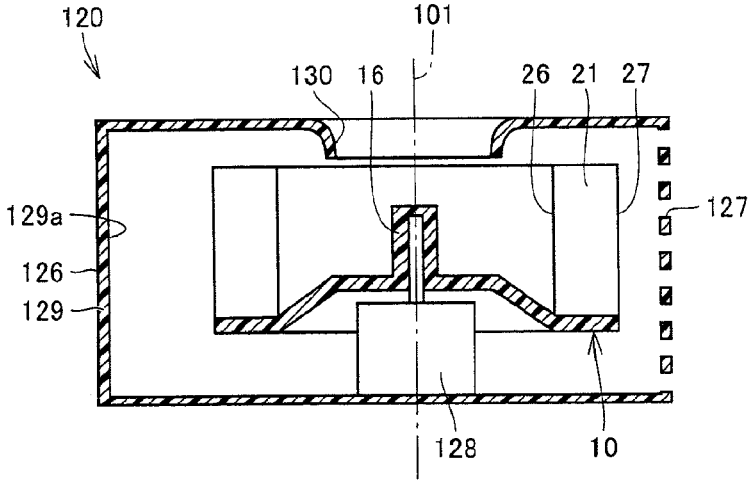
FIG. 12 is a cross-sectional view of the blower taken along a line XII-XII in FIG. 11.

FIG. 11 is a cross-sectional view of a blower using the centrifugal fan in FIG. 1. FIG. 12 is a cross-sectional view of the blower taken along a line XII-XII in FIG. 11. Referring to FIG. 11 and FIG. 12, a blower 120 has a driving motor 128, centrifugal fan 10, and a casing 129 inside an outer casing 126.

The output shaft of driving motor 128 is coupled to boss portion 16 of centrifugal fan 10. Casing 129 has a guide wall 129*a*. Guide wall 129*a* is formed by an approximately ¾ arc arranged on the periphery of centrifugal fan 10. Guide wall 129*a* is formed to guide an airflow generated by rotation of fan blade 21 to the rotation direction of fan blade 21 while increasing the speed of the air flow.

Casing 129 has an intake portion 130 and an outlet portion 127. Intake portion 130 is formed to be positioned on an extension of center axis 101. Outlet portion 127 is formed to be open to one side of the tangent direction of guide wall 129*a* from part of guide wall 129*a*. Outlet portion 127 is shaped like a prismatic cylinder protruding from part of guide wall 129*a* to one side of the tangent direction of guide wall 129*a*.

Driven by driving motor 128, centrifugal fan 10 rotates in the direction shown by an arrow 103. Here, air is taken in from intake portion 130 to the inside of casing 129 and is blown from a radially inside space 131 to a radially outside space 132 of centrifugal fan 10. The air blown to radially outside space 132 circumferentially flows in the direction shown by an arrow 104 and is blown to the outside through outlet portion 127.

Figure 13:
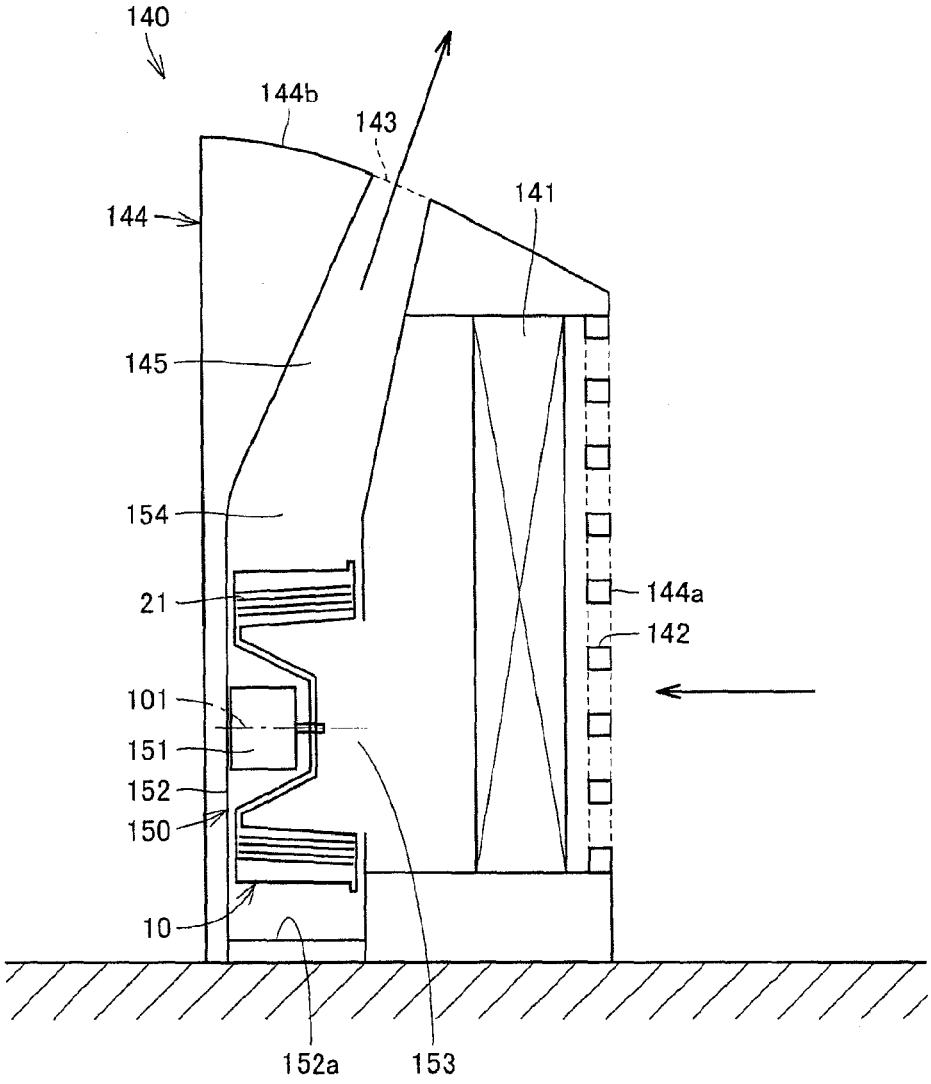
FIG. 13 is a cross-sectional view of an air purifier using the centrifugal fan in FIG. 1.

FIG. 13 is a cross-sectional view of an air purifier using the centrifugal fan in FIG. 1. Referring to FIG. 13, an air purifier 140 has a housing 144, a blower 150, a duct 145, and an HEPA (High Efficiency Particulate Air Filter) filter 141.

Housing 144 has a rear wall 144*a* and a top wall 144*b*. Housing 144 has an intake port 142 for taking in the air in the room in which air purifier 140 is installed. Intake port 142 is formed at rear wall 144*a*. Housing 144 further has an outlet port 143 discharging the purified air to the inside of the room. Outlet port 143 is formed at top wall 144*b*. Air purifier 140 is generally installed against a wall such that rear wall 144*a* is opposed to a wall in the room.

Filter 141 is arranged to face intake port 142 in the inside of housing 144. The air introduced to the inside of housing 144 through intake port 142 passes through filter 141 to become the purified air with foreign matters removed.

Blower 150 is provided to take in the room air to the inside of housing 144 and to blow the air purified by filter 141 to the room through outlet port 143. Blower 150 has centrifugal fan 10, a casing 152, and a driving motor 151. Casing 152 has a guide wall 152*a*. Casing 152 has an intake portion 153 and an outlet portion 154.

Duct 145 is provided above blower 150 and is provided as an air channel for guiding the purified air from casing 152 to outlet port 143. Duct 145 has a prismatic cylindrical shape with its lower end connecting to outlet portion 154 and with its upper end open. Duct 145 is configured to guide the purified air blown from outlet portion 154 to a laminar flow toward outlet port 143.

In air purifier 140 having such a configuration, fan blade 21, driven by blower 150, rotates to cause the room air to be taken in from intake port 142 to the inside of housing 144. Here, an air flow is generated between intake port 142 and outlet port 143, and foreign matters such as dust included in the intake air are removed by filter 141.

The purified air obtained by passage through filter 141 is taken in to the inside of casing 152. Here, the purified air taken in to the inside of casing 152 forms a laminar flow through guide wall 152*a* around fan blade 21. The air in the form of a laminar flow is guided to outlet portion 154 along guide wall 152*a* and blown from outlet portion 154 to the inside of duct 145. The air is discharged from outlet port 143 toward the external space.

In air purifier 140 in the fourth embodiment of the present invention configured in this manner, the use of centrifugal fan 10 having an excellent blowing capacity reduces power consumption of driving motor 151. Accordingly, it is possible to obtain air purifier 140 that can contribute to energy savings.

Although an air purifier has been described by way of example in this embodiment, the centrifugal fan in the present invention is also applicable to a fluid feeding device such as, for example, an air conditioner, a humidifier, a cooling device, and a ventilating device.

Fifth Embodiment

In the present embodiment, each of centrifugal fan 10 shown in FIG. 1 and a centrifugal fan for comparison having a fan blade without a concave portion and a convex portion formed on blade surface 23 is mounted in air purifier 140 shown in FIG. 13. Each example carried out using that air purifier 140 will be described.

In the example described below, centrifugal fan 10 and the centrifugal fan for comparison each having a diameter of 200 mm and a height of 70 mm were used, where the shape including the size and arrangement of fan blade 21 was the same excluding the presence/absence of the concave portion and the convex portion.

Figure 14:
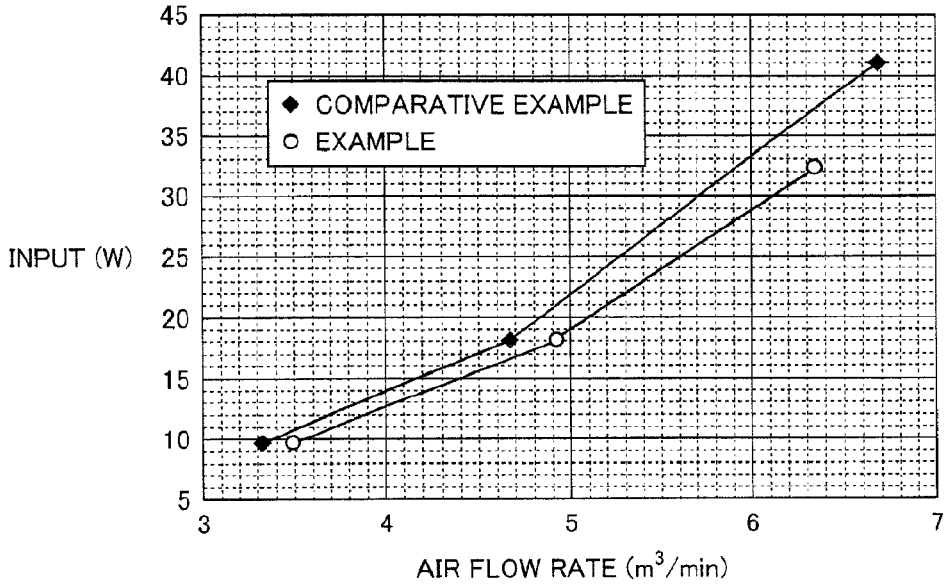
FIG. 14 is a graph showing the relation between the air flow rate of the centrifugal fan and power consumption of a driving motor in an example of the present invention.

FIG. 14 is a graph showing the relation between the air flow rate of the centrifugal fan and the power consumption of a driving motor in the example. Referring to FIG. 14, in the example, the power consumption of the driving motor was measured at various air flow rates, in each of the case using centrifugal fan 10 and the case using the centrifugal fan for comparison. As a result of measurement, it was confirmed that as compared with the centrifugal fan for comparison, centrifugal fan 10 reduced power consumption of the driving motor at the same flow rate.

Figure 15:
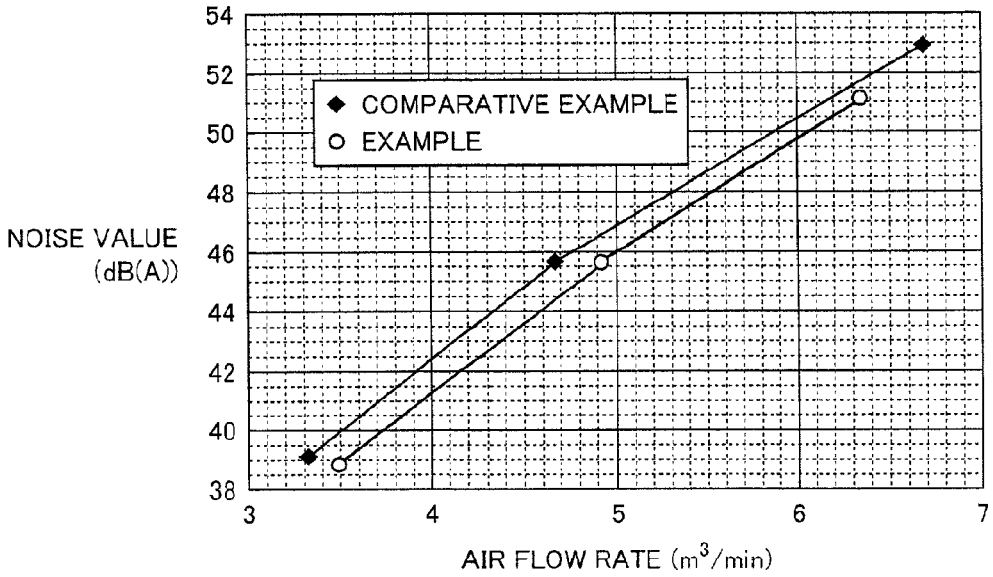
FIG. 15 is a graph showing the relation between the air flow rate of the centrifugal fan and noise value in the example.

FIG. 15 is a graph showing the relation between the air flow rate of the centrifugal fan and noise value in the example. Referring to FIG. 15, in the example, the noise value was measured at various air flow rates, in each of the case using centrifugal fan 10 and the case using the centrifugal fan for comparison. As a result of the measurement, it was confirmed that as compared with the centrifugal fan for comparison, centrifugal fan 10 reduced the noise value at the same flow rate.

Figure 16:
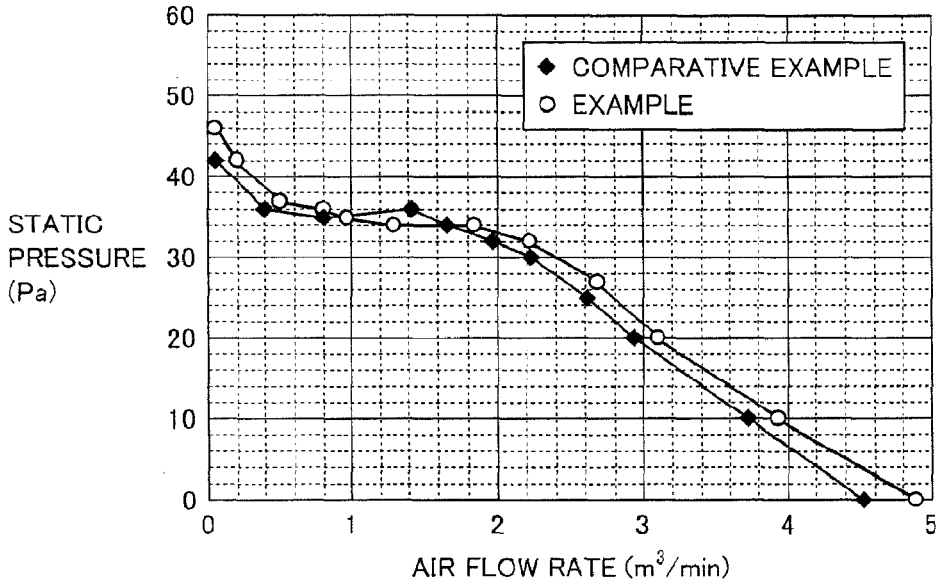
FIG. 16 is a graph showing pressure-flow rate characteristics of the centrifugal fan in the example.
Figure 17:
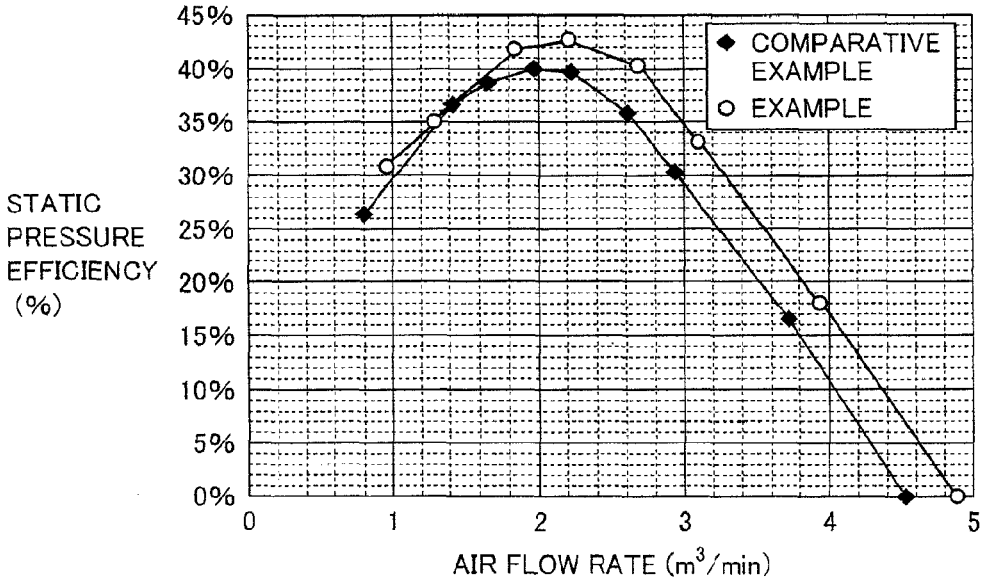
FIG. 17 is a graph showing a static pressure efficiency (static pressure×air flow rate/input) at each air flow rate in FIG. 16.

FIG. 16 is a graph showing pressure-flow rate characteristics of the centrifugal fan in the example. Referring to FIG. 16, the figure shows the pressure-flow rate characteristics (P: static pressure–Q: air flow rate) of centrifugal fan 10 and the centrifugal fan for comparison at a constant rotation speed. FIG. 17 is a graph showing a static pressure efficiency (static pressure×air flow rate/input) at each air flow rate in FIG. 16.

Referring to FIG. 16 and FIG. 17, centrifugal fan 10 improved in the P-Q characteristics at the same rotation speed, as compared with the centrifugal fan for comparison. Furthermore, the static pressure efficiency at the same air flow rate was improved and the motor efficiency was significantly improved.

The structures of the centrifugal fan as described in the foregoing first to third embodiments may be combined as appropriate to form a new centrifugal fan. The molding die and the fluid feeder described in the fourth embodiment are applicable to a variety of centrifugal fans described in the first to third embodiments and to a centrifugal fan formed of a combination thereof.

The embodiment disclosed here should be understood as being illustrative rather than being limitative in all respects. The scope of the present invention is shown not in the foregoing description but in the claims, and it is intended that all modifications that come within the meaning and range of equivalence to the claims are embraced here.

INDUSTRIAL APPLICABILITY

The present invention is mainly applied to home electric equipment having an air blowing function, such as an air purifier and an air conditioner.

REFERENCE SIGNS LIST

10 centrifugal fan, 12, 13 peripheral frame, 16 boss portion, 21 fan blade, 23 blade surface, 24 suction surface, 25 pressure surface, 26 front edge portion, 27 rear edge portion, 31 air flow, 32 vortex, 41 flection portion, 42, 43 curved portion, 51, 52, 61, 62, 71, 72 convex portion, 56, 57, 66, 67, 76, 77 concave portion, 101, 106 center line, 110 molding die, 112 movable die, 114 stationary die, 116 cavity, 120, 150 blower, 126 outer casing, 127, 154 outlet portion, 128, 151 driving motor, 129, 152 casing, 129*a*, 152*a* guide wall, 130, 153 intake portion, 131 radially inside space, 132 radially outside space, 140 air purifier, 141 filter, 142 intake port, 143 outlet port, 144 housing, 144*a* rear wall, 144*b* top wall, 145 duct

The invention claimed is:

1. A centrifugal fan comprising a plurality of vane portions provided to be circumferentially spaced apart from each other, each having a front edge portion to which air flows in and a rear edge portion from which air flows out, a rotation direction of the centrifugal fan is a direction of rotation that causes an air flow such that air flows in at the front edge portion and air flows out at the rear edge portion, said rear end portion is at a forward position relative to said front end portion in the direction of rotation of the centrifugal fan, wherein said vane portion has a blade surface extending between said front edge portion and said rear edge portion and including a pressure surface arranged on a rotation direction side of the centrifugal fan and a suction surface arranged on a back side of said pressure surface, and said vane portion has such a blade cross-sectional shape that a concave portion is formed at said pressure surface and said suction surface when said vane portion is cut along a plane orthogonal to a rotation axis of the centrifugal fan, said vane portion has a flection portion formed by flexing a center line of said blade cross-sectional shape extending between said front edge portion and said rear edge portion, at a plurality of points, and arranged at a region within a half of a length of the center line that is toward said front edge portion such that bending angles in the flection portion decrease in a region after the half of the center line toward said rear end portion, wherein the bending angle is an angle of flection from the center line at the respective point of flection, said vane portion is formed to be inclined in the rotation direction of the centrifugal fan from said front edge portion toward said rear edge portion, said concave portion is formed by said flection portion, said flection portion has a bending pattern extending in a zig-zag shape from said front edge portion toward said rear edge portion as a starting point to be said front edge portion, a plurality of said concave portions are formed to repeatedly appear at said pressure surface and said suction surface in a direction from said front edge portion toward said rear edge portion by said bending pattern, and each of said concave portions formed by said bending pattern has an approximately V-shaped cross-sectional shape.

2. The centrifugal fan according to claim 1, wherein said flection portion is flexed such that a depth of said concave portion is larger than a thickness of said vane portion at at least one point.

3. The centrifugal fan according to claim 1, wherein said concave portion is formed to extend from one end to the other end of said blade surface in a rotation axis direction of the centrifugal fan.

4. The centrifugal fan according to claim 1, wherein said concave portion is formed at said pressure surface and said suction surface to repeatedly appear in the direction in which said front edge portion is connected with said rear edge portion.

5. The centrifugal fan according to claim 1, wherein said concave portion formed at said pressure surface forms a convex portion at said suction surface, and said concave portion formed at said suction surface forms a convex portion at said pressure surface.

6. The centrifugal fan according to claim 1, wherein in said blade cross-sectional shape, said concave portion is formed between convex portions appearing at said blade surface, and said concave portion and said convex portions are formed to be alternately aligned in a direction in which said front edge portion is connected with said rear edge portion.

7. The centrifugal fan according to claim 1, wherein said vane portion has said blade cross-sectional shape having a generally constant thickness between said front edge portion and said rear edge portion.

8. The centrifugal fan according to claim 1, wherein the centrifugal fan is made of resin.

9. A fluid feeder comprising a blower configured to include the centrifugal fan of claim 1 and a driving motor coupled to said centrifugal fan to rotate a plurality of said vane portions.

* * * * *